US005520677A

United States Patent [19]

Hansen

[11] Patent Number: 5,520,677

[45] Date of Patent: May 28, 1996

[54] INFUSION CONTAINER WITH TWO CONNECTIONS

[76] Inventor: Bernd Hansen, Heerstrasse 16, 74429 Sulzbach-Laufen, Germany

[21] Appl. No.: 392,218

[22] Filed: Feb. 22, 1995

[30] Foreign Application Priority Data

Feb. 24, 1994 [DE] Germany ..... 44 05 965.5

[51] Int. Cl.[6] ..... A61J 1/05

[52] U.S. Cl. ..... 604/403; 604/415; 604/905; 222/479; 215/247; 215/DIG. 3; 128/DIG. 12; 128/DIG. 26

[58] Field of Search ..... 128/912, DIG. 12, 128/DIG. 24, DIG. 26; 215/247, 249, 248, 355, DIG. 3; 604/403, 408, 415, 905; 222/479, 482, 541.2

[56] References Cited

U.S. PATENT DOCUMENTS

| | | | |
|---|---|---|---|
| 1,903,915 | 4/1933 | Smith | 222/541.2 |
| 2,202,163 | 5/1940 | Mulford et al. | 222/541.2 |
| 2,770,234 | 11/1956 | Nesset et al. | 222/479 |
| 3,456,647 | 7/1969 | Wada | 222/479 |
| 3,589,422 | 6/1971 | Bellamy et al. | 128/DIG. 24 |

FOREIGN PATENT DOCUMENTS

| | | | |
|---|---|---|---|
| 0065469 | 11/1982 | European Pat. Off. . | |
| 2504253 | 8/1975 | Germany . | |
| 2809855 | 9/1978 | Germany . | |
| 4025894 | 4/1991 | Germany . | |
| 8602906 | 5/1986 | WIPO | 604/404 |

*Primary Examiner*—David H. Willse
*Assistant Examiner*—P. Zuttarelli
*Attorney, Agent, or Firm*—Roylance, Abrams, Berdo & Goodman

[57] ABSTRACT

An infusion container has a first connection for feed of a medication and a second connection for removal of the contents of the container. The first connection and the second connection are configured of one piece with a plug. The plug is inserted in a neck part of the infusion container and is connected tightly with this neck part. The two connections form two supports projecting on the outside of the plug and face away from the inside of the container. Each support incorporates a conduit passing through the plug.

13 Claims, 4 Drawing Sheets

Fig.6
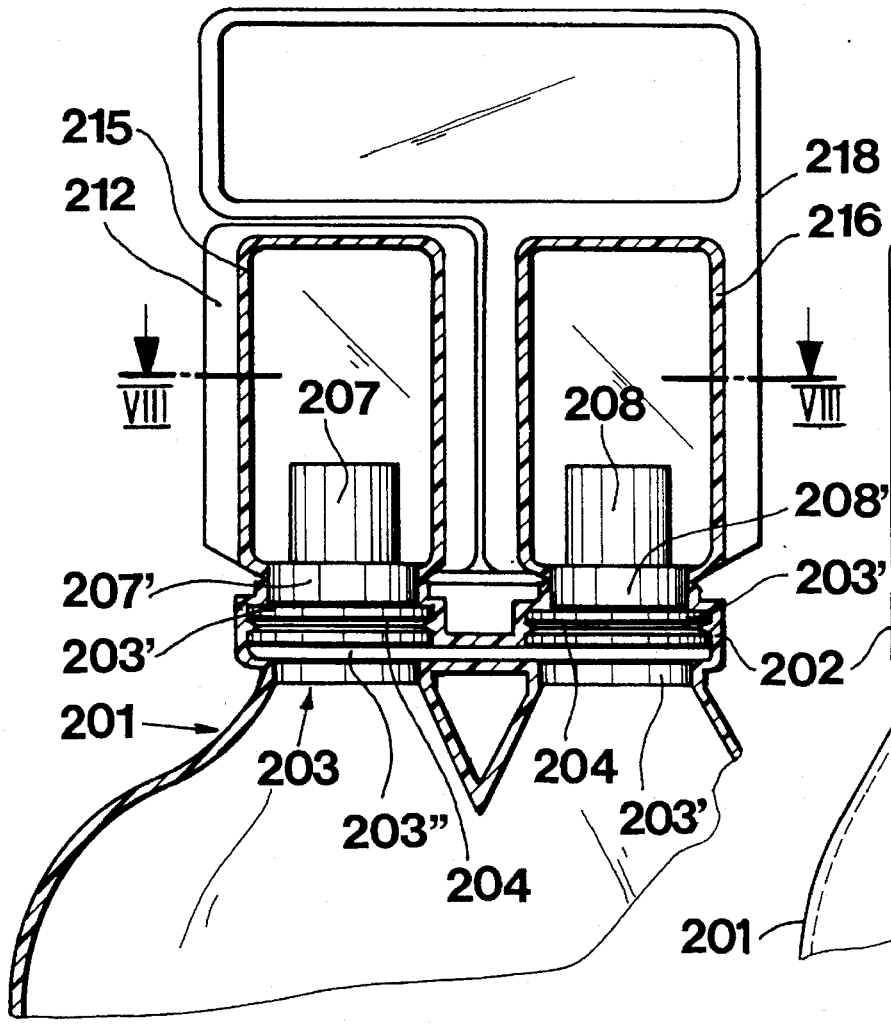
Fig.7
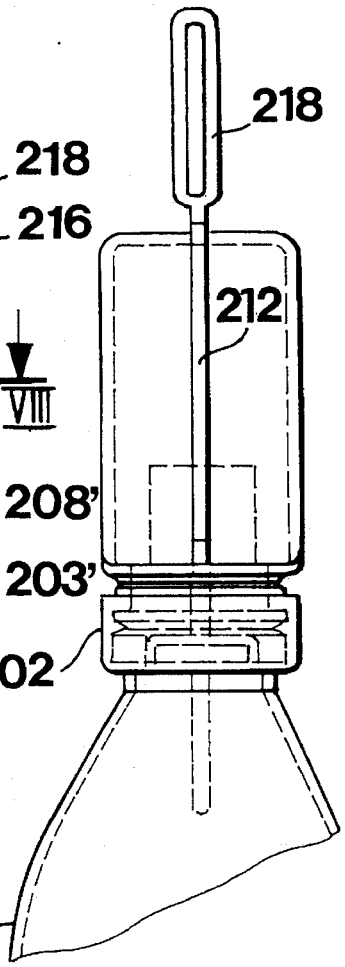
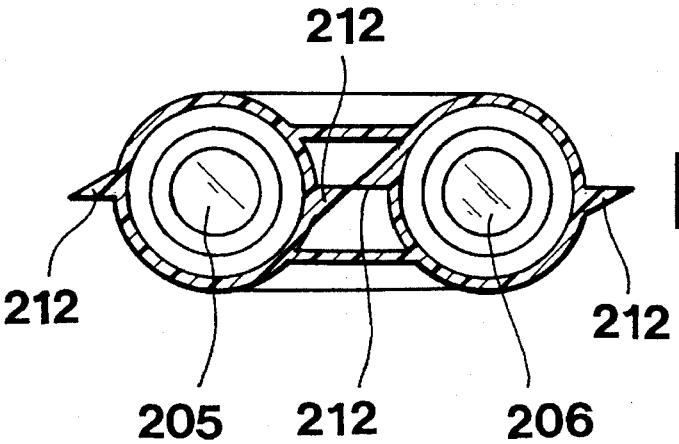
Fig.8

INFUSION CONTAINER WITH TWO CONNECTIONS

FIELD OF THE INVENTION

The present invention relates to an infusion container with a first connection for the feed of a medication into the container and a second connection for removal of the container contents.

BACKGROUND OF THE INVENTION

Known infusion containers of this type are generally pouches comprising two sheets of foil material welded together. After welding together of the foil sheets and before filling the pouch, the two connections are glued or welded in. The gluing or welding of the container is costly.

SUMMARY OF THE INVENTION

An object of the present invention is to provide an infusion container provided with the required two connections at lower cost than the known or conventional infusion containers.

The foregoing object is attained by an infusion container comprising a neck, a plug, first and second connections and a cover. The plug is received within and hermetically sealed to the neck, and has first and second conduits passing therethrough. Form-locking means, on the neck and plug, connect the neck to the plug. The form-locking means are longitudinally aligned and intermeshing. The first connection and the second connection are for feeding and removing, respectively, contents to and from the container, are unitary parts of the plug, and have first and second supports, respectively, connected to the first and second conduits, respectively. The cover extends over the portion of the plug not within the neck, and encloses and protects the supports.

The insertion of the plug in the neck of the container and the joining of the plug with the neck can be accomplished easily and can be performed automatically in the same machine in which the container is manufactured by blow molding or vacuum molding and then is filled. The intermeshing material parts of neck and plug facilitate not only the production of a tight closing of the neck by the plug, but also a form-locking connection of the plug with the neck in axial alignment with the neck. The plug provided with the connections is then inserted at remarkably lower cost than the known glued or welded connections.

Another important advantage is that, without additional cost following insertion of the plug, the connections can be protected and can be kept sterile by means of at least one protecting cover formed onto the neck and overlapping or covering the connections. A predetermined breaking line between the protecting cover and the neck enable the protecting cover to be separated from the neck easily and without auxiliary tools. In other words, the cover can be broken off manually. In addition, the one-piece configuration of the two connections with the plug and the construction of the connections according to the invention, the part providing the connections and the plug can be manufactured at very low cost.

Adaptation of the arrangement of the connections to different requirements is possible, without any difficulty, despite the one-piece construction of the connections with the plug. For example, the longitudinal axes of the conduits of the first and second connections can be arranged diametrically opposite a central longitudinal axis of the plug and can be inclined in the plane defined by these three axes. The conduit longitudinal axes can be inclined at the same angle in opposite directions from the plug central longitudinal axis. The supports are then also simultaneously very easily accessible. The longitudinal axes of the two conduits, however, could also lie in two planes parallel to one another, and thus, could be inclined in opposite directions. Preferably, the two planes are symmetrical to the central longitudinal axis of the plug. The longitudinal axes of the two conduits could be parallel to one another and at some spacing from one another. The supports could be arranged in engagement with one another or at some spacing from one another.

Preferably, each of the two conduits is closed off by a diaphragm configured in one-piece or unitary construction with the plug or the support. If the material of the diaphragm does not enable sealed closing of a hole after the diaphragm has been pierced, a layer of natural rubber or thermoplastic elastomer can be applied to the diaphragm. A layer of such material is capable of tightly closing a pierced hole automatically and completely.

The diaphragms need be arranged only at one end of the conduit. An arrangement within the conduit or within the support is also easily possible.

In addition to covering the supports with the protecting cover or covers, a support also can be closed off in the area of its free end. A cap or removable hood can be provided. The cap or hood is preferably formed of latex or of a thermoplastic elastomer.

In a preferred embodiment, this cap or removable hood is configured so that it has a segment projecting into the support and a segment overlapping the support on its outside, looping around it and being attached thereto.

Other objects, advantages, and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 6 is a partial side elevational view of an infusion container according to a third embodiment of the present invention having a plug with connections and having two break-off closings formed on the neck;

FIG. 7 is a partial side view of the container of FIG. 6;

FIG. 8 is a plan view in section taken along line VIII—VIII of FIG. 6;

DETAILED DESCRIPTION OF THE INVENTION

An infusion container 1 is manufactured in a blow molding machine from an extruded tube or two sheet foils. The container comprises a neck 2, and a cylindrical plug 3 inserted in neck 2 and joined by a seal with the neck to be form-locked in the axial direction. One segment of plug 3 is provided with an annular slot 4 opening laterally or radially outwardly and circumventing the plug outer surface. This segment is followed by a second segment of neck 2 with a smaller diameter.

Figure 3:
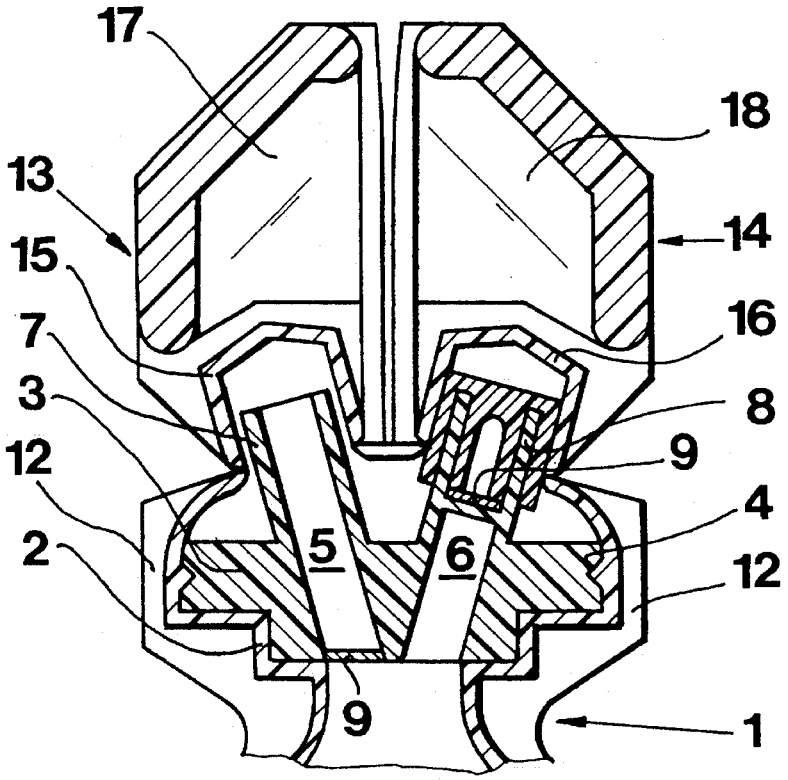
FIG. 3 is a side elevational view in longitudinal section of the neck of an infusion container with the inserted plug of FIG. 2 and two break-off closings formed on the neck.

As shown in FIG. 3, neck 2, which is pressed against the outer surface of plug 3 during molding, not only engages on the outer surface of the portion of plug 3 having the greater diameter, but also engages the plug with a bead-like material part received in annular slot 4. The bead-like part fills the annular slot completely. The neck also lies tightly on the annular surface forming the transition to the plug segment with the smaller diameter, as well as on its outer surface and on a part of its front surface. Annular slot 4 and the annular, bead-like material part of neck 2 received therein produce a form-locking axial connection of neck 2 and contribute to tight closing of neck 2 by plug 3.

Two conduits 5 and 6 pass through plug 3. The longitudinal axes of the conduits are arranged diametrically opposite relative to the central longitudinal axis of plug 3, and are inclined in the plane defined by the longitudinal axes of conduits 5 and 6, as well as the central longitudinal axis of plug 3, at the same angle in opposite directions relative to the central longitudinal axis. In this manner, the intersecting point of the longitudinal axes lies inside infusion container 1.

Supports 7 and 8 are formed on the front side of the greatest diameter segment of plug 3. The diameter of supports 7 and 8 is identical to that of conduits 5 and 6. Conduits 5 and 6 and supports 7 and 8 need not have overall identical diameters as in the illustrated first embodiment. Their shape and size could be adapted to the requirements. For instance, the inside chamber of the support or even of the conduit can be widened in an outward conical taper, preferably in the direction of the free end of the support.

Conduit 5 and support 7 form a first connection for feed of a medication. Conduit 6 and support 8 form a second connection for removal of the container contents.

Conduit 5 is hermetically sealed at its end, not facing or remote from support 7, by a diaphragm 9 configured in one integral piece with plug 3. Support 8 is hermetically sealed by a diaphragm 10 constructed in one integral piece with this member. If the material forming plug 3 and diaphragms 9 and 10 cannot seal the diaphragm completely shut again following its being pierced, then, as shown in connection with diaphragm 10, the diaphragms on one side or both sides can be provided with a layer 10' of latex or a thermoplastic elastomer. Such layer will ensure re-closure of a pierced hole.

The member, configured of one piece forming plug 3 with two supports 7 and 8 and two diaphragms 9 and 10, is made of plastic. In the embodiment shown, that member is a die-molded part. Thermoplastic elastomers or even hardened materials, such as polypropylene, can be used for the member.

Figure 1:
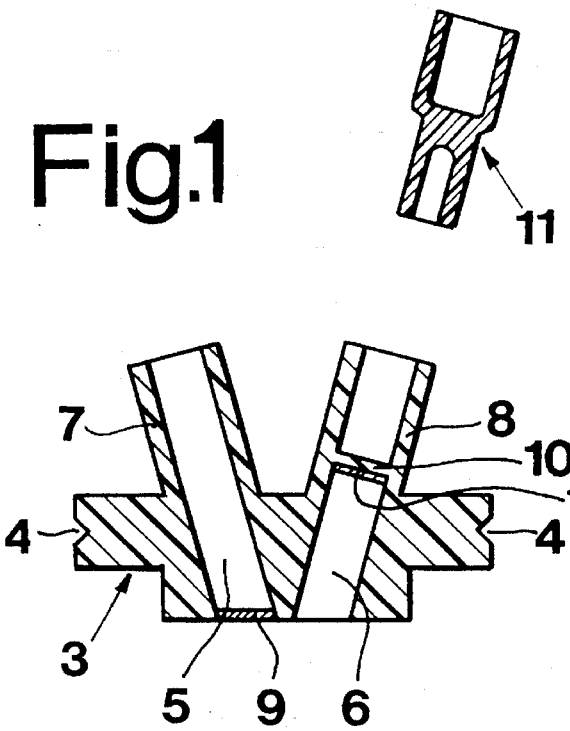
FIG. 1 is a side elevational view in longitudinal section of a plug with connections formed according to a first embodiment of the present invention, and a closing cap or removable hood for one of the supports.
Figure 2:
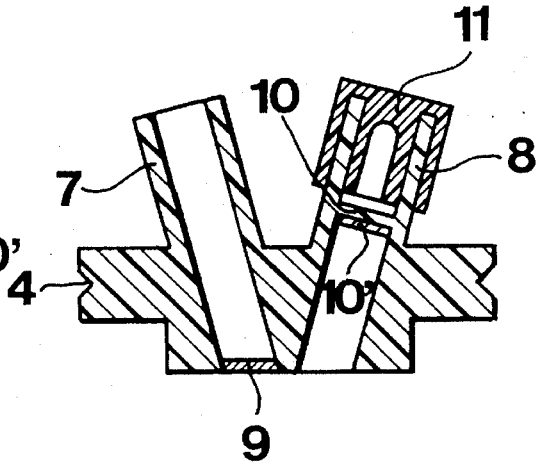
FIG. 2 is a side elevational view in longitudinal section through the plug of FIG. 1 with cap or removable hood placed on the one support.

To provide at least the one support with a closing arrangement in the area of its free end, it is possible, as shown for support 8 in FIGS. 1–3, to provide a cap or removable hood 11. Hood 11 is of latex in this embodiment, but can be of some other elastomer. Cap or removable hood 11 has a first segment with a central blind bore. The first segment is received in support 8 and forms a seal. A second hood segment has a central blind bore, and can be bent back over the first segment, and thus, can be inverted over support 8, as shown in FIGS. 2 and 3.

In the manufacture of infusion pouch 1, plug 3 is secured in the not yet completely formed neck 2. Neck 2 is completely formed only when it becomes tightly set on plug 3. Two flattened zones 12 lie in the separating plane of the mold or tool for forming neck 2. Zones 12 are attached to neck 2 and arranged on the outside of neck 2 diametrically opposite one another.

As shown in FIG. 3, plug 3 overhangs neck 2. The neck ends approximately at half the length of the two supports 7 and 8 at some distance from these supports. Break-off closings 13 and 14 are attached to this neck end, one each for the two supports 7 and 8. Break-off closings 13 and 14 are each attached at a breaking line 20 of reduced thickness on the neck end. In the embodiment shown, the two break-off closings 13 and 14 each form a protecting cover 15 or 16 extending over the respective support 7 or 8. The cap or removable hood 11 is placed on the support. One-piece handles or similar means 17 and 18 are connected to covers 15 and 16, respectively. The two break-off closings 13 and 14 could be separated from neck 2 independently from one another.

Figure 4:
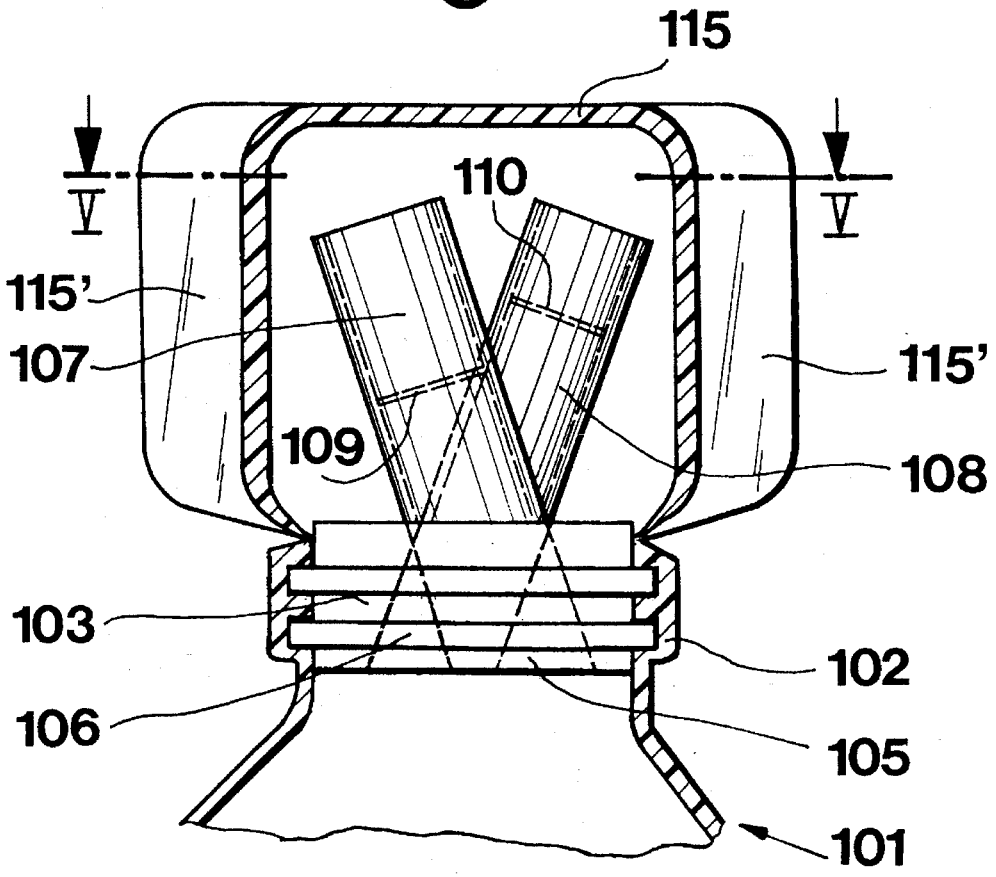
FIG. 4 is a partial side elevational view in longitudinal section of an infusion container according to a second embodiment of the present invention having an inserted plug with connections and having a break-off closing.
Figure 5:
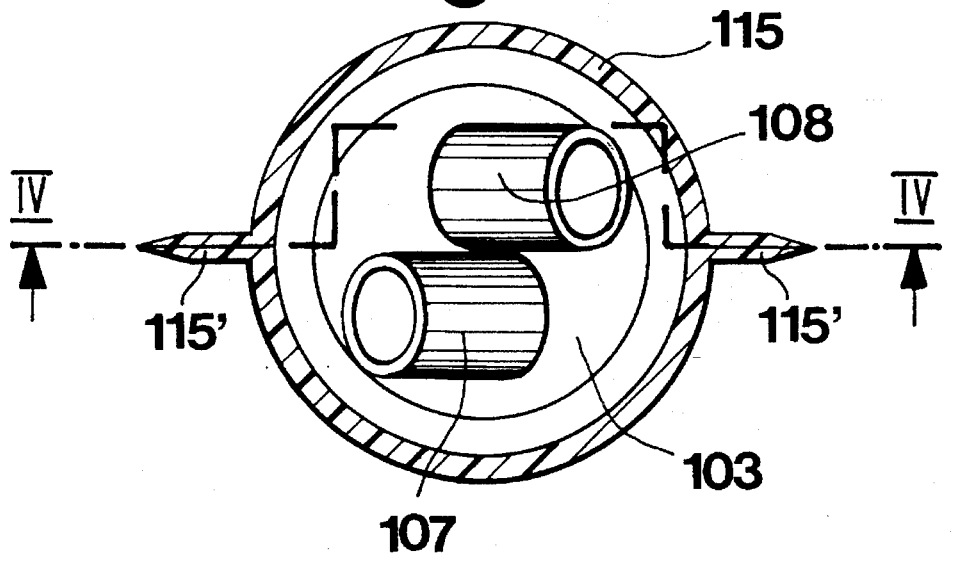
FIG. 5 is a plan view in section taken along line V—V of FIG. 4.

In the embodiment shown in FIGS. 4 and 5, an infusion container 101 according to the invention has plug 103 inserted in its neck 102. The plug is sealed to the neck. The neck is axially adapted to the plug shape, as well as two radially outwardly projecting, circumventing ribs 103' on the plug. The ribs are arranged at a certain axial space from one another and facilitate the tight connection between plug 103 and neck 102, and produce a form-lock connection at this section. The shaping of neck 102, following insertion of plug 103, overlaps ribs 103' and tightly secures the neck on the frontal surface areas of the ribs. The inside wall of the neck has two annular slots receiving ribs 103'.

Two cylindrical conduits 105 and 106 pass through plug 103. Their longitudinal axes lie in two planes parallel to each other and are arranged symmetrical to the central longitudinal axis of plug 103, as shown particularly in FIG. 5. As in the first embodiment, the longitudinal axes of the two conduits 105 and 106 are inclined in opposite directions, at the same angle, relative to a line running perpendicular to the front surface of plug 103. Two supports 107 and 108 are formed on the front or end of plug 103 coaxial to the conduits 107 and 108, respectively. The front or end of plug 103 lies in one single radial plane and tapers outwardly over the end of neck 102 as in the embodiment shown in FIGS. 1–3.

The inside diameter of supports 107 and 108 is determined to be identical to that of the associated conduit. Each of the two supports 107 and 108 is hermetically sealed by a one-piece diaphragm 109 and 110, respectively. Each diaphragm is integral with the respective support and is located at some distance from its free end. As in the first embodiment, one or both sides of these diaphragms can be provided with a layer of latex or some other material capable of resealing a pierced opening.

A protective cover 115 is formed at the end of neck 102, over which plug 103 extends. The protecting cover extends over or overhangs both supports 107 and 108, as shown in FIG. 4. Protecting cover 115 is connected through a breaking line 120 having reduced wall thickness located in the area between the last rib 103' and the outwardly tapering front of plug 103. In the exemplary embodiment, cover 115 has two diametrically opposite, outwardly projecting, pressed flat zones 115'. Flat zones 115' facilitate secure engagement of protecting cover 115, and facilitate separation of protecting cover 115 from neck 102 by a tipping or twisting motion relative to the neck.

The embodiment shown in FIGS. 6–8 is manufactured similarly to the other embodiments in a blow molding or vacuum molding machine. A plug 203 is inserted into neck 202 of infusion container 201. The plug has two cylindrical parts 203' spaced from one another and axially parallel to one another. Parts 203' are connected with one another by a middle part 203" in the form of a plate. As can be seen particularly in FIG. 6, neck 202 surrounds the two parts 203', and is received in the peripheral annular slot 204 to form a form-lock connection in the axial direction. This coupling also assists in forming a sealed connection between plug 203 and neck 202. Neck 202 also engages on the outwardly tapering front surface of cylindrical parts 203', as well as on the plate-like middle part. 203".

A conduit 205 or 206 passes through the center of each of the two cylindrical parts 203'. A cylindrical support 207 or 208 is attached to each of the two conduits 205 and 206 at their outsides. At each attachment of the supports 207 and 208 with plug 203, the supports have a segment 207' or 208' of enlarged diameter. The diaphragms which close off the two connections formed by the conduits and supports can be provided in the area of the supports or the conduits.

Neck 202 ends in the area of segments 207' and 208'. Each protecting cover 215 and 216 overlaps the supports 207 and 208 on the neck end. The covers are each connected with neck 202 through a breaking line 220 of reduced wall thickness. The two protecting covers or removable hoods 215 and 216 are each provided with two pressed flat zones 212 projecting in diametrically opposite directions. The zones facilitate the secure engagement of the protecting covers or removable hoods 215 and 216 when breaking them off from neck 202. In this embodiment, a flat handle member 218 is attached to the end of protecting cover or removable hood 216 at a location remote from neck 202. The handle overlaps protecting cover or removable hood 215.

Figure 9:
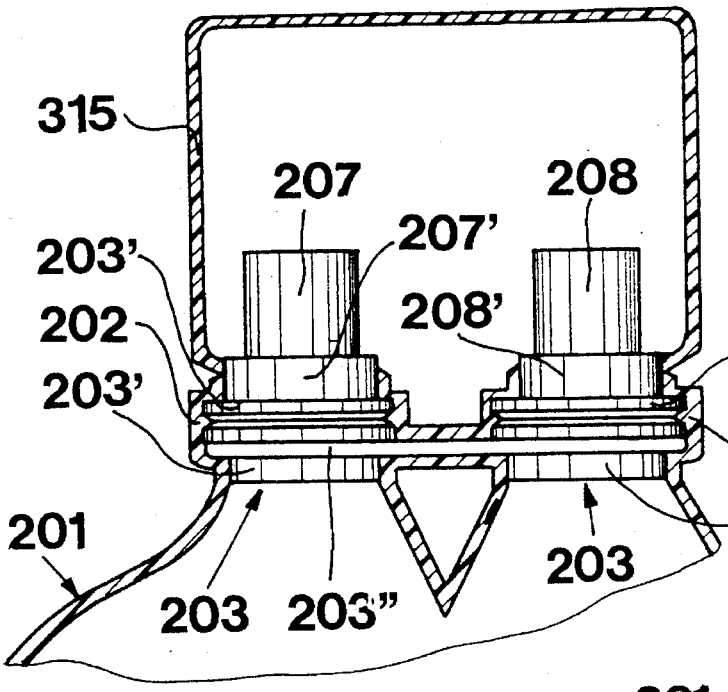
FIG. 9 is a partial side elevational view of an infusion container according to a fourth embodiment of the present invention having a plug with connections and having a break-off closing formed on the neck.
Figure 10:
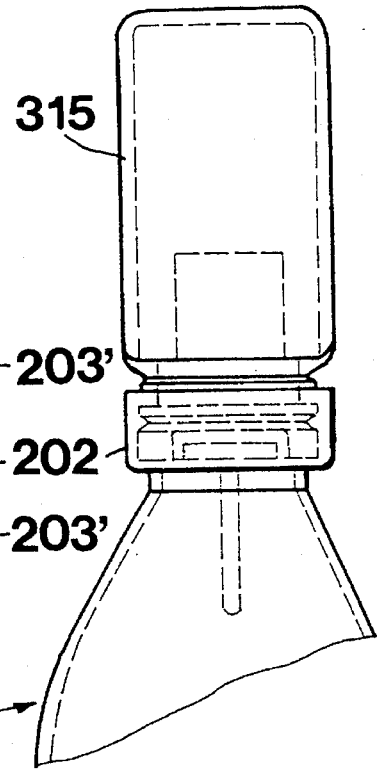
FIG. 10 is a partial side view of the container of FIG. 9.
Figure 11:
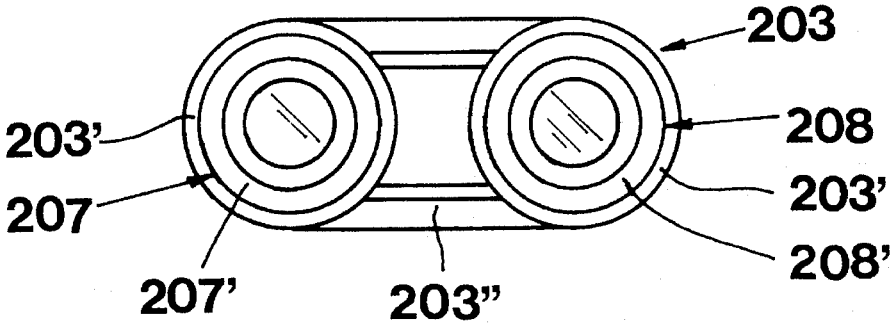
FIG. 11 is a plan view of the plug of FIGS. 9 and 10.

The fourth embodiment of an infusion container shown in FIGS. 9–11 differs from the embodiment shown in FIGS. 6–8 only by the different construction of the means for protecting the two supports 207 and 208. Consequently, identical parts are shown with the same reference numbers. The two supports 207 and 208 are covered by one single protecting cover 315. Cover 315 is connected with the end of neck 202 in the area of segments 207' and 208' at a breaking line of reduced wall thickness. The two narrow sides (shown in FIG. 10) of protecting cover 315 are formed by semi-cylindrical surface areas, whereas the broad sides (shown in FIG. 9) are formed by flat wall parts. The separation of protecting cover 315 from neck 202 can be performed manually, as in the other embodiments, without the aid of tools.

While various embodiments have been chosen to illustrate the invention, it will be understood by those skilled in the art that various changes and modifications can be made therein without departing from the scope of the invention as defined in the appended claims.

What is claimed is:

1. An infusion container, comprising:

a neck;

a plug received within and hermetically sealed to said neck, said plug having first and second conduits passing therethrough;

form-locking means, on said neck and said plug, for connecting said neck to said plug, said form-locking means being longitudinally aligned and intermeshing;

a first connection and a second connection for feeding and removing, respectively, contents to and from the container, said first and second connections being unitary parts of said plug and having first and second supports, respectively, connected to said first and second conduits, respectively; and a cover extending over a portion of said plug not within said neck and enclosing and protecting said supports.

2. An infusion container according to claim 1, wherein said first and second conduits comprise first and second longitudinal axes, respectively, arranged diametrically opposite relative to a central longitudinal axis of said plug, and inclined in a plane defined by said first and second longitudinal axes and said central longitudinal axis at substantially equal angles in opposite directions relative to said central longitudinal axis.

3. An infusion container according to claim 2, wherein said first and second longitudinal axes intersect said central longitudinal axis inside the container.

4. An infusion container according to claim 1, wherein said first and second conduits comprise first and second longitudinal axes, respectively, extending in parallel planes and inclined in opposite directions.

5. An infusion container .according to claim 4, wherein said parallel planes are symmetrically arranged relative to a central longitudinal axis of said plug; and said first and second longitudinal axes are inclined equally relative to said central longitudinal axis.

6. An infusion container according to claim 1, wherein said first and second conduits comprise first and second longitudinal axes, respectively, which are parallel and spaced apart.

7. An infusion container according to claim 6 wherein said first and second supports are separated by a space.

8. An infusion container according to claim 1, wherein first and second diaphragms close said first and second connections, respectively, said diaphragms being formed unitarily with one of said plug and said supports.

9. An infusion container .according to claim 8, wherein said first diaphragm is spaced by a distance from each end of said first conduit.

10. An infusion container .according to claim 8, wherein said first diaphragm is located at an end of said first conduit within the container.

11. An infusion container according to claim 8, wherein a layer of natural rubber or thermoplastic elastomer is applied to one side of said first diaphragm.

12. An infusion container according to claim 1, wherein said form-locking means comprises an annular slot and an annular bead received with and filling said slot.

13. An infusion container .according to claim 1, wherein said plug comprises a front face supporting said supports and extending in a single radial plane.

* * * * *